350-96.29 SR
4/29/86 XR 4,586,030

United States Patent [19]

Klostermann

[11] Patent Number: 4,586,030

[45] Date of Patent: Apr. 29, 1986

[54] PROTECTIVE GRATING

[76] Inventor: Horst Klostermann, Maischützenstr. 2c, 4630 Bochum, Fed. Rep. of Germany

[21] Appl. No.: 576,000

[22] Filed: Feb. 1, 1984

[30] Foreign Application Priority Data

Feb. 8, 1983 [DE] Fed. Rep. of Germany ..... 3304186
Mar. 24, 1983 [DE] Fed. Rep. of Germany ..... 3310726

[51] Int. Cl.[4] ..... G08B 13/18

[52] U.S. Cl. ..... 340/550; 340/555; 250/221; 350/96.29

[58] Field of Search ..... 340/550, 555, 556; 250/221; 350/96.23, 96.29

[56] References Cited

U.S. PATENT DOCUMENTS 3,183,499 5/1965 Cowen ..... 340/555
4,275,294 6/1981 Davidson ..... 350/96.23 X
4,399,430 8/1983 Kitchen ..... 340/550
4,450,434 5/1984 Nielsen et al. ..... 340/550 X
4,488,040 12/1984 Rowe ..... 350/96.29 X

FOREIGN PATENT DOCUMENTS 3306002 8/1984 Fed. Rep. of Germany ..... 340/555
2038060 7/1980 United Kingdom ..... 340/550
2098770 5/1981 United Kingdom ..... 340/556

*Primary Examiner*—James L. Rowland
*Assistant Examiner*—Brian R. Tumm
*Attorney, Agent, or Firm*—Collard, Roe & Galgano

[57] ABSTRACT

There is provided a protective grating which consists of tube-shaped grating rods disposed parallel to one another and grating rods disposed parallel to one another and at right angles to the tube-shaped grating rods. On respective opposite ends of the tube-shaped grating rods are disposed light sources and light receivers, so that light passes from the light sources through the hollow space of the tube-shaped grating rods to the light receivers. During interruption of the light beam an alarm is triggered.

5 Claims, 4 Drawing Figures

PROTECTIVE GRATING

The present invention relates to a protective grating for guarding openings in buildings or for marking the boundaries of real property. More particularly the present invention relates to a protective grating having hollow grating rods which extend in a straight line containing an optical supervisory system which triggers an alarm signal when the grating rods are cut.

A protective grating of this kind is disclosed in German DE-OS No. 30 29 712. In the grating fence described therein the protective grating includes hollow grating rods wound in a snake-like form wherein electrical or optical leads are threaded into the hollow spaces thereof. Several such protective gratings are assembled into a fence. If the grating rods of such a protective grating are cut, then the corresponding optical or electrical lead is interrupted or damaged so as to trigger an alarm.

It is a disadvantage of such a protective grating that, on the one hand, it is complicated and costly to manufacture and, on the other hand, following damage of such a protective grating, its repair is very time consuming because new leads must be threaded into the repaired grating, which causes difficulty. A further disadvantage of the known protective gratings is that the supervisory system does not react to a bending of the protective grating, since an electrical or optical lead can be bent together with the grating rod without thereby triggering an alarm. A similar protective grating having the same disadvantages is disclosed in DE-AS No. 26 53 056.

It is, therefore, an object of the present invention to further develop a protective grating of the above-described kind, so that it can be manufactured more simply, is easier to repair, and triggers an alarm at a certain degree of bending of the grating rods.

This object, as well as others which will hereinafter become apparent, is accomplished according to the present invention by providing that the light sources or light receivers be disposed on respective opposite ends of the grating rods, and that the light pass through the hollow space of the grating rods directly from the light source to the light receiver.

Manufacture of such a protective grating is simple, as threading in of any leads can be dispensed with. Similarly, its repair is also facilitated. Upon destruction or damage of such a tube-shaped grating rod, it need only be replaced and when a light source of a light receiver is not operating, it can be quickly replaced in a trouble free manner. Furthermore, the supervisory system of such a protective grating responds when the grating rod is bent, since in that case light does not pass or passes inadequately to the light receiver.

In an advantageous implementation of the present invention, the light sources are light diodes and the light receivers are photo diodes. Light diodes and photo diodes have become inexpensive mass produced products, which have shown their operating reliability. They operate at a low expenditure of energy and can be constructed in an arbitrarily small size, depending on the requirement.

If the sensitivity of the light receiver is adjustable, then there also results an adjustability of the sensitivity of response of the protective grating. In the event the alarm is to be triggered upon a slight degree of bending of the grating rods, then the sensitivity of the light receiver is so adjusted that a minor attenuation of the impinging light is sufficient to trigger an alarm. If, however, the response sensitivity of the protective grating is to be even less than the afore-described sensitivity, then the sensitivity of the light receiver is so adjusted that only a stronger attenuation of the impinging light triggers an alarm. This sensitivity adjustment can be simply and easily accomplished by merely exchanging the light receivers for more or less sensitive receivers.

So as to ensure a reliable operation of the protective grating according to the invention over long intervals of time, the interior of the tube-shaped grating rods can optionally be provided with a protective layer to protect against corrosion. Due to the smooth surface of the interior of the grating rod resulting from such coating, an improved light behavior of the grating rod results so that it is possible to operate with precisely defined light conditions. Alternately, the interior of the grating rod can be filled entirely or partially with transparent material, for example, a transparent synthetic material.

During use of the protective grating according to the present invention in a security fence having hollow fence posts, the tube-shaped grating rods are disposed horizontally and their ends project into the hollow spaces of the fence posts. Consequently, light sources and light receivers disposed on respective ends of the horizontally-extending grating rods are protected against exterior influences, such as weather or violent forces. Furthermore, it is not possible to ascertain from an outside examination that a security fence equipped in this manner contains an electronic supervisory system.

In a further advantageous development of the invention, it is provided that light sources and light receivers are arranged on rails disposed in the fence posts. In this implementation, the manufacture of the fence, and the capability to repair it are further simplified.

The grating rods of the protective grating need not be individually equipped with light sources and light receivers, so that during subsequent use any protective grating which is destroyed or damaged can be quickly replaced by a new one. In this case the rails having the light sources or light receivers can be removed from the old protective grating and plugged into the new protective grating. If, however, disturbances arise within the region of the light sources or the light receivers, only the corresponding rail need be replaced. A time consuming search for the source of the error can therefore be dispensed with.

The present invention will be described and understood more readily when considered together with the embodiments depicted in the accompanying drawings, in which.

Figure 1:
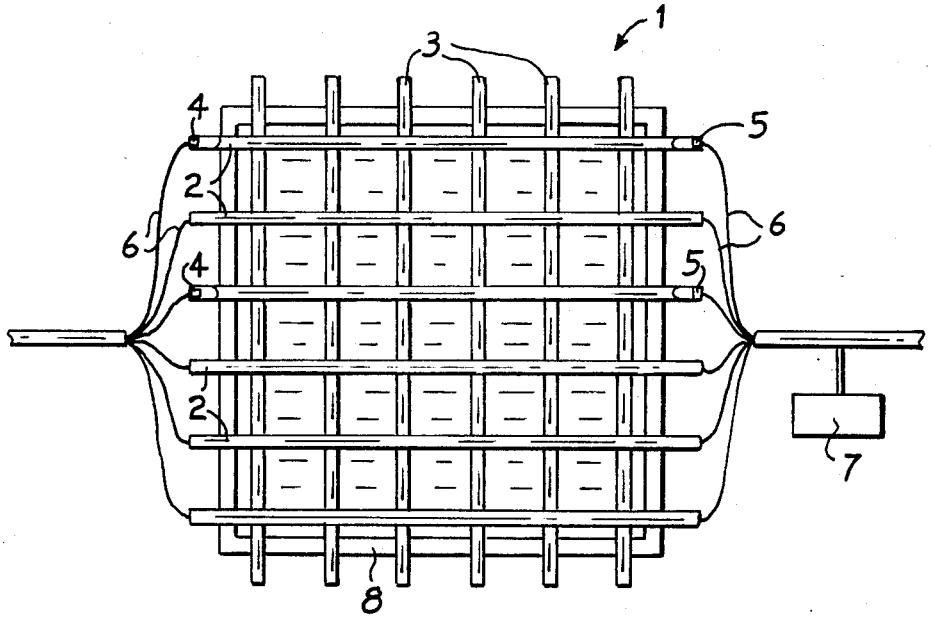
FIG. 1 shows a plan view of a protective grating according to the present invention, with the grating rods shown partially in section.

Turning now to the drawings, there is shown in FIG. 1 a protective grating, generally designated 1, consisting of grating rods 2 disposed parallel to one another, and grating rods 3 also disposed parallel to one another and extending at right angles to grating rods 2. Grating rods 2 are tube-shaped and have disposed in their openings on one side of the protective grating 1 light diodes 4, and on the other side photo diodes 5. Both the light diodes 4, as well as the photo diodes 5 are connected to energy supply and signal transmission leads 6. The signals supplied by photo diodes 5 are processed in an electronic supervisory device 7. In this version, protective grating 1 serves as a protection for a sky light, designated 8.

The protective grating operates as follows. Light diodes 4 constantly transmit light which impinges through the tube-shaped grating rods 2 at a defined light strength on photo diodes 5. If a tube-shaped grating rod 2 is bent or cut, then no light or light at an inadequate strength impinges on photo diode 5. Any deviation from the set sensitivity value of photo diode 5 is determined by electronic supervisory device 7, which, in this case, triggers an alarm. The sensitivity of photo diodes 5 can be so chosen, that at a low degree of bending of grating rods 2, any light which still passes to the photo diode 5 as a result of scattering, is adequate to prevent triggering of the alarm. In this manner, the protective grating does not trigger an alarm if it is only slightly bent, for example, by children playing or by animals colliding with the grating.

Figure 3:
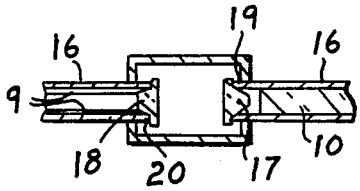
FIG. 3 shows a horizontal cross-sectional view through a post of the fence of FIG. 2 taken along line B—B′ of FIG. 2.

The inner surfaces of the tube-shaped grating rods may be provided with a protective layer 9, as clearly seen in FIG. 3, so that corrosion will have no effect on a long standing protective grating and so that the light conditions remain constant over a long period of time.

Alternatively, the interior of the hollow grating rod can also be filled entirely or partially with transparent material, for example, synthetic glass, as clearly seen on the right hand side of FIG. 3 wherein the transparent material is designated 10.

Figure 4:
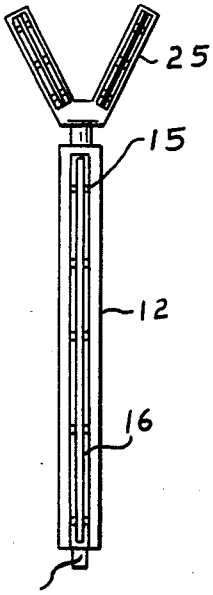
FIG. 4 shows a side elevational view of a post of the fence of FIG. 2 taken along the line A—A′ of FIG. 2.
Figure 2:
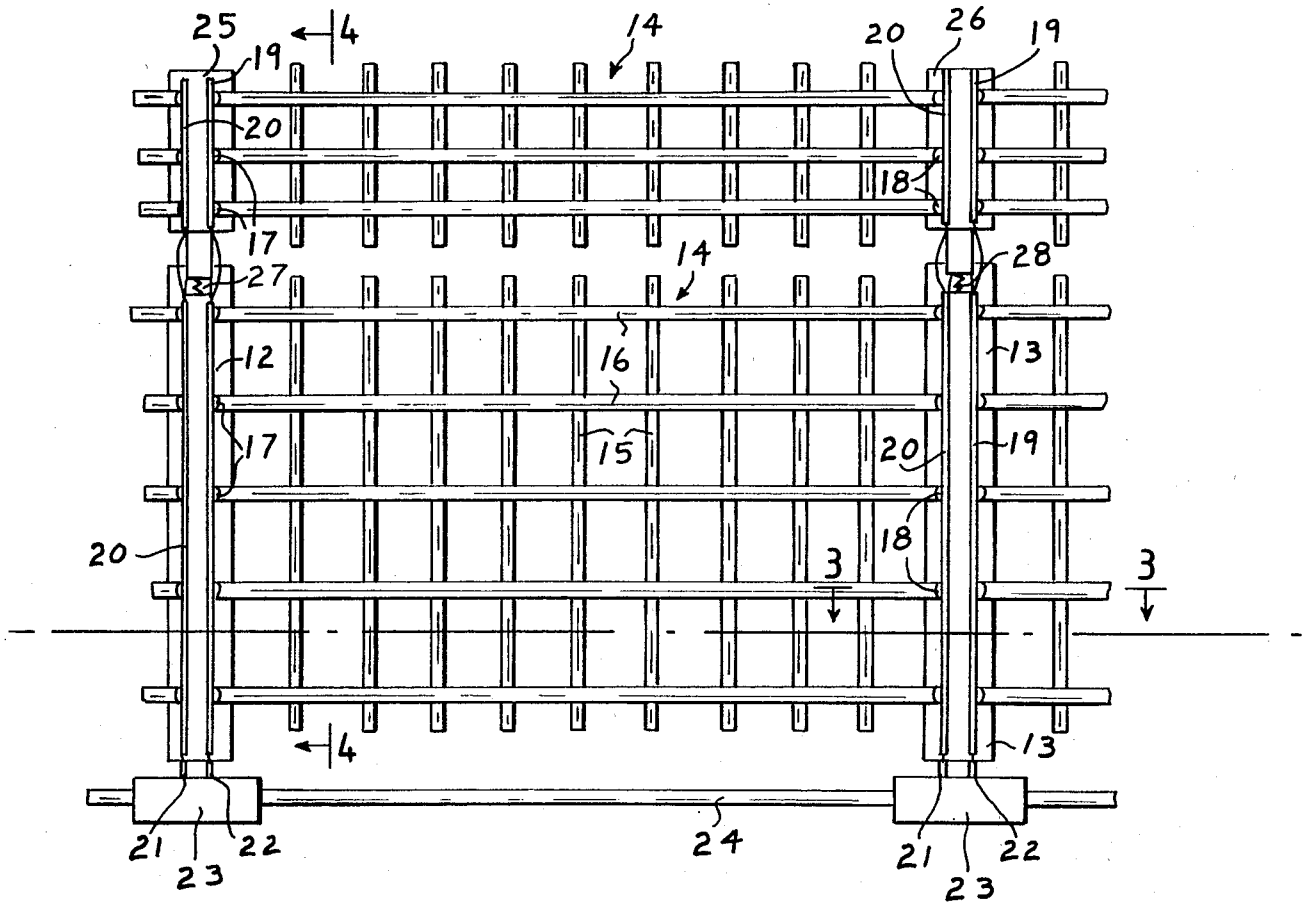
FIG. 2 shows an elevational view of a segment of a fence employing protective gratings according to the present invention.

In FIG. 2 there is shown a portion of a security fence including a protective grating according to the present invention. Between two hollow fence posts 12 and 13 embedded in the ground, there is disposed a protective grating, designated 14. Protective grating 14 consists of upright or vertical grating rods 15 and of horizontal tube-shaped grating rods 16. The lower part of protective grating 14 is also embedded in the ground. In the openings of tube-shaped grating rods 16 there are disposed light diodes 17 on one side of protective grating 14, while on the opposite side thereof are disposed photo diodes 18. Light diodes 17 and the photo diodes 18 are disposed respectively on rails 19 and 20, which also contain the energy supply leads and signal transmission leads for light diodes 17 and photo diodes 18. At the ends of rails 19 and 20 facing the ground, there are disposed plug-in elements 21 and 22, which, in turn, may be connected to distribution boxes 23. Distribution boxes 23 are disposed in the ground below the fence and are connected with one another through electrical supply and transmission cables 24. Above protective grating 14 and fence posts 12 and 13, there are disposed Y-shaped beams 25 and 26, as shown in FIG. 4, which carry corresponding gratings 14. Y-shaped beams 25 and 26 are provided with supervisory switches 27 and 28 supported in fence posts 12 and 13, respectively, which, in the case of any load acting thereon, trigger an alarm signal passed to the supervisory center. The ends of horizontal grating rods 16 equipped with light diodes 17 and photo diodes 18 are disposed in the hollow spaces of the fence posts 12 and 13, or in Y-shaped beams 25 and 26, so as to be protected.

It is understood that the foregoing general and detailed descriptions are exemplary of the present invention and are not to be interpreted as restrictive of the scope of the following claims.

What is claimed is:

1. A protective grating for guarding building openings and the like, said protective grating comprising straight hollow grating rods having an optical supervisory system for triggering an alarm signal when the grating rods are cut or bent, said optical supervisory system including light diodes and photo diodes disposed on respective opposite ends of said grating rods, the light passing therebetween passing through the hollow space of the grating rods directly from the light diodes to the photo diodes, said protective grating being employed in a fence having hollow fence posts and the hollow grating rods extending horizontally with their ends projecting into the hollow spaces of the fence posts.

2. The protective grating according to claim 1, wherein said light sources and said light receivers are arranged on rails disposed in said fence posts.

3. The protective grating according to claim 1, wherein the inner space of the hollow grating rods is entirely filled with transparent material.

4. The protective grating according to claim 1, wherein the interior of the hollow grating rods is provided with a protective layer.

5. The protective grating according to claim 1, wherein the inner space of the hollow grating rods is partially filled with transparent material.

* * * * *